US008726444B2

(12) United States Patent
Gaines et al.

(10) Patent No.: US 8,726,444 B2
(45) Date of Patent: May 20, 2014

(54) STARCH HEAD FOR CLEANING A TARGET SURFACE

(75) Inventors: Joseph Michael Gaines, Cincinnati, OH (US); Hirotaka Uchiyama, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 207 days.

(21) Appl. No.: 13/073,274

(22) Filed: Mar. 28, 2011

(65) Prior Publication Data

US 2012/0246850 A1 Oct. 4, 2012

(51) Int. Cl.
*A47L 13/17* (2006.01)

(52) U.S. Cl.
USPC ..... 15/104.93; 15/244.4; 15/176.1

(58) Field of Classification Search
USPC ..... 15/104.93, 171, 176.1, 244.4, 210.1, 15/145
See application file for complete search history.

(56) References Cited

U.S. PATENT DOCUMENTS

| | | | |
|---|---|---|---|
| 2,560,649 | A | 7/1951 | Garland |
| 4,522,738 | A | 6/1985 | Magid et al. |
| 4,863,655 | A | 9/1989 | Lacourse et al. |
| 5,378,832 | A | 1/1995 | Kurane et al. |
| 5,440,775 | A | 8/1995 | Banks |
| 5,471,697 | A | 12/1995 | Daconta |
| 5,706,553 | A | 1/1998 | Riley et al. |
| 5,878,459 | A | 3/1999 | McParland |
| 5,888,002 | A | 3/1999 | Fenstersheib |
| 6,146,494 | A | 11/2000 | Seger et al. |
| 6,183,150 | B1 | 2/2001 | Kao |
| 6,231,970 | B1 | 5/2001 | Andersen et al. |
| 6,649,188 | B2 | 11/2003 | Gilleland et al. |
| 6,709,526 | B1 | 3/2004 | Bailey et al. |
| 6,832,405 | B1 | 12/2004 | Miller |
| 6,846,480 | B2 * | 1/2005 | Smith et al. ..... 424/70.1 |
| 6,880,197 | B2 | 4/2005 | Katz et al. |
| 6,966,720 | B2 | 11/2005 | Moss |
| D513,444 | S | 1/2006 | Vitantonio et al. |
| 7,032,270 | B2 | 4/2006 | Vitantonio et al. |
| 7,059,008 | B2 | 6/2006 | Morgan et al. |
| 7,065,823 | B2 | 6/2006 | Llanes |
| 7,131,783 | B1 | 11/2006 | DeRoma |
| 7,159,265 | B2 | 1/2007 | Soller et al. |

(Continued)

FOREIGN PATENT DOCUMENTS

| | | | |
|---|---|---|---|
| EP | 1 600 096 | A2 | 11/2005 |
| GB | 2 158 701 | A | 11/1985 |

(Continued)

OTHER PUBLICATIONS

U.S. Appl. No. 12/901,804, Oct. 11, 2010, Vetter, et al.

(Continued)

*Primary Examiner* — Shay Karls
(74) *Attorney, Agent, or Firm* — Larry L. Huston; Steven W. Miller

(57) ABSTRACT

A head for cleaning a target surface, such as a toilet bowl. The head has a longitudinal axis and comprises a starch based material. The material may be provided as a sheet, and formed to make a generally round head or a head of laminae. The head may optionally contain granules, which optionally define a core and improve the stiffness of the head. The starch based material may be extruded to have a machine direction oriented in the longitudinal direction of the cleaning device.

18 Claims, 6 Drawing Sheets

(56) References Cited

U.S. PATENT DOCUMENTS

| | | | | |
|---|---|---|---|---|
| 7,169,740 | B2 | 1/2007 | Sommerville-Roberts et al. | |
| 7,275,276 | B2 | 10/2007 | Jaszenovics et al. | |
| D556,406 | S | 11/2007 | Murphy | |
| 7,316,046 | B2 * | 1/2008 | Michaels et al. | 15/210.1 |
| 7,375,070 | B2 | 5/2008 | Pegelow et al. | |
| D572,872 | S | 7/2008 | Bergh | |
| 7,467,437 | B2 | 12/2008 | Hagleitner et al. | |
| D588,365 | S | 3/2009 | Conway et al. | |
| 7,530,138 | B1 | 5/2009 | Platt | |
| 7,581,276 | B2 | 9/2009 | Endo et al. | |
| 7,595,290 | B2 | 9/2009 | Pounds et al. | |
| 7,603,739 | B2 | 10/2009 | Minkler et al. | |
| 7,650,663 | B2 | 1/2010 | Michaels et al. | |
| 7,666,261 | B2 | 2/2010 | Bailey et al. | |
| D614,373 | S | 4/2010 | Zach et al. | |
| 7,704,328 | B2 | 4/2010 | Bailey et al. | |
| 7,742,451 | B2 | 6/2010 | Haumont et al. | |
| 7,743,451 | B2 | 6/2010 | Kim | |
| 7,761,950 | B2 | 7/2010 | Konishi et al. | |
| D622,017 | S | 8/2010 | Murphy | |
| 7,788,758 | B2 * | 9/2010 | Konishi et al. | 15/210.1 |
| 7,938,908 | B2 * | 5/2011 | Bailey et al. | 127/29 |
| 7,939,010 | B2 | 5/2011 | James et al. | |
| 7,951,440 | B2 | 5/2011 | Butler, III | |
| 8,541,356 | B2 * | 9/2013 | Saint Victor | 510/438 |
| 2001/0014388 | A1 * | 8/2001 | Bastioli et al. | 428/315.7 |
| 2002/0054784 | A1 | 5/2002 | Wolf | |
| 2004/0048759 | A1 | 3/2004 | Ribble et al. | |
| 2005/0074275 | A1 | 4/2005 | Hart et al. | |
| 2005/0155628 | A1 | 7/2005 | Kilkenny et al. | |
| 2005/0266230 | A1 | 12/2005 | Hill et al. | |
| 2006/0225237 | A1 | 10/2006 | Garland | |
| 2006/0254012 | A1 | 11/2006 | Kilkenny et al. | |
| 2007/0081850 | A1 | 4/2007 | DeRoma | |
| 2008/0003906 | A1 | 1/2008 | Hill et al. | |
| 2008/0250590 | A1 | 10/2008 | Trefethren et al. | |
| 2008/0263797 | A1 * | 10/2008 | Berger et al. | 15/104.93 |
| 2009/0170971 | A1 | 7/2009 | Lee et al. | |
| 2009/0312215 | A1 | 12/2009 | Glenn et al. | |
| 2010/0306937 | A1 | 12/2010 | Magid et al. | |
| 2011/0281324 | A1 | 11/2011 | Adams et al. | |
| 2012/0246850 | A1 | 10/2012 | Gaines et al. | |

FOREIGN PATENT DOCUMENTS

| | | | |
|---|---|---|---|
| GB | 2 362 565 | A | 11/2001 |
| WO | WO 2005/034704 | A1 | 4/2005 |
| WO | WO 2009/080130 | A1 | 7/2009 |

OTHER PUBLICATIONS

U.S. Appl. No. 13/073,308, Mar. 28, 2011, Uchiyama, et al.
U.S. Appl. No. 13/073,346, Mar. 28, 2011, Uchiyama, et al.
PCT Search Report; Dtd Sep. 6, 2013; 10 Pages.

* cited by examiner

STARCH HEAD FOR CLEANING A TARGET SURFACE

FIELD OF THE INVENTION

The present invention is directed to cleaning devices and more particularly to cleaning devices suitable for cleaning a wet target surface. The device may comprise a cleaning head removably attachable to a handle.

BACKGROUND OF THE INVENTION

Devices for cleaning dirty and unsanitary areas are well known in the art. Typically such devices have a cleaning head for contacting and cleaning the surface of the unsanitary area. The head may be attached to an elongate handle, so that the user's hand is remote from, and does not contact, the dirty and unsanitary surface during cleaning. Typical target surfaces include a toilet, sink, countertop, floor, or other hard surface.

One example of such a device is a toilet brush. The toilet brush may have bristles at one end which are immersed in the toilet bowl, often times with cleanser. The cleanser may be separately dispensed into the toilet bowl. Dual brush heads may be employed, as taught by U.S. Pat. No. 5,440,775. A two-sided scrub brush having bristles and a sponge head may be employed, as taught by U.S. Pat. No. 6,832,405.

The brush head may be permanently attached to an elongate handle for gripping by the user. The handle is intended to prevent the user's hand from being wetted by the water in the toilet bowl.

One attempt to provide convenience to the cleaning task is to have a toilet bowl brush with an integrated refillable reservoir. The cleaning fluid is disposed in dispensed from the reservoir, as shown in U.S. Pat. No. 7,131,783. Another attempt is U.S. Pat. No. 6,880,197 having a brush head which may include a toilet cleaning chemical embedded therein. However, these attempts do not overcome the problems encountered after the cleaning task is finished.

After cleaning, the toilet brush is then typically stored until the next use. However, the toilet brush may be wet, and unsanitary even if rinsed. The toilet brush may have an unpleasant smell and/or breed germs.

An attempt to overcome this problem has been to develop a head which is detachable from the handle. The head may be discarded after a single use, obviating the need to store that head under unpleasant and/or unsanitary conditions. One such attempt in the art is found in U.S. Pat. No. 5,888,002 which teaches a head having a brush molded from a one-piece flexible plastic material. The brush may be supplied with detergent or disinfectant. After use, the brush is disposed in a bag and discarded. However this attempt simply moves the unsanitary head from storage to a disposable bag. The user must handle the dirty head after each use to place it in the bag and then discard that bag.

An attempt to overcome this problem has been to use flushable brush heads. The flushable brush heads are typically made of sheets of water dissolvable material, as taught by U.S. Pat. Nos. 7,059,008; 7,159,265; 7,316,046; 7,581,276; and 7,650,663. Commercial embodiments of cleaning brushes having a head with sheet material have not been well accepted, apparently because the sheet material does not provide enough cleaning power to be efficacious.

WO 2009/080130 acknowledges this drawback in a cleaning device having paper material, and even paper material impregnated with detergent. But the '130 attempt at a solution is to provide a cleaning element having biodegradable plastic material, for example 70-80 percent polyvinyl alcohol and the remainder poly plasticizers. But these materials are known to slowly dissolve, leading to difficulty with flushing. Even if the device appears too large to be safely flushed after use, the user may separately discard the head—leading back to the unsanitary conditions sought to be avoided.

Attempts to improve upon the heads comprising sheet material is found in U.S. Pat. No. 7,530,138 which teaches a brush heads having loops made of paper. Again, it is unlikely the paper will provide sufficient cleaning power to be efficacious. Another attempt is found in U.S. Pat. No. 7,761,950 which teaches water disintegrable cords. However, these cords are simply found by twisting a water-disintegrable sheet, such as a nonwoven. One attempt to overcome these problems is found in US 2005/0074275 which teaches a cleaning device having a single dose of non-aqueous or anhydrous powder made of a water soluble foil, such as PVA.

An attempt to improve upon the water soluble foil is found in US 2008/0263797 which teaches a brush head having a dissolvable wrapper. This attempt further teaches the use of sheet materials having about 90 to 100% cellulosic pulp fibers—and takes us back to the earlier attempts using sheet materials and the associated problem upon saturation of insufficient stiffness to provide effective cleaning. Yet another attempt to use a cleaning head formed from a cellulose-containing substances such as paper is found in U.S. Pat. No. 7,743,451.

Yet another head may be made according to U.S. Pat. Nos. 2,644,185; 5,471,697; 7,275,276 and/or 2002/0054784. A head made of a rolled up material strip is shown in U.S. Pat. No. 7,467,437. The use of starch based materials is also known, as shown in commonly assigned U.S. Pat. Nos. 7,491,443 and in 4,863,655; RE 39,339/5,662,731; 6,183,150; 6,649,188; 6,231,970; 5,378,832; 2009/0312215; 2008/0003906; 2005/0266230; 2004/0048759 and 2001/014388. The use of granular and liquid materials is shown in commonly assigned P&G Case No. 11892, Ser. No. 12/901,804, filed Oct. 11, 2010.

All of the aforementioned brush heads must be attached to a handle for the convenience and sanitation of the user. Illustrative handles are taught in U.S. Pat. Nos. 5,706,553; 5,878,459; 6,966,720; 7,032,270; 7,065,825; 7,603,739; 7,743,451; 2007/0081850; 2008/0250590; D513,444; D 556,406; D 572,872; D588,365; D614,373; and/or D622,017.

However none of the aforementioned attempts in the art overcome the dueling problems of providing flushability with sufficient cleaning power to be efficacious. Accordingly, there is still a need in the art for an improved cleaning device, usable for cleaning unsanitary areas such as a toilet.

SUMMARY OF THE INVENTION

The invention comprises a head for cleaning a target surface and optionally being attachable to a handle. The head comprises a starch-based substance, such as foam. The head may optionally comprise at least one stiffening member, granular material, liquid and/or other cleanser.

DETAILED DESCRIPTION OF THE INVENTION

Figure 1:
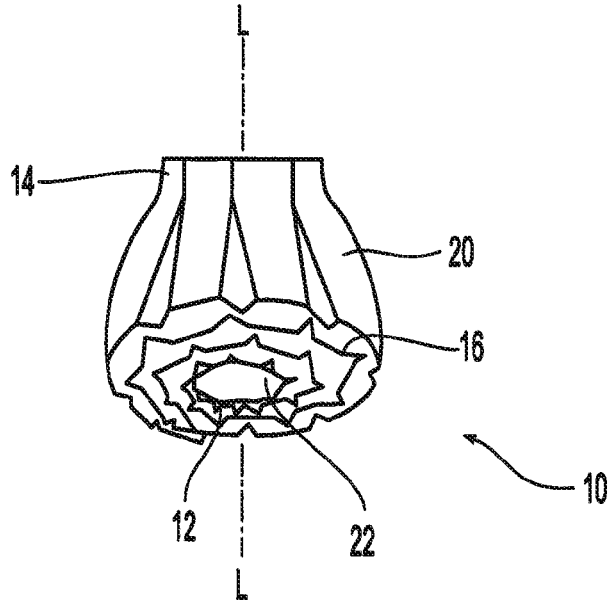
FIG. 1 is a perspective view of a head according to the present invention.
Figure 2:
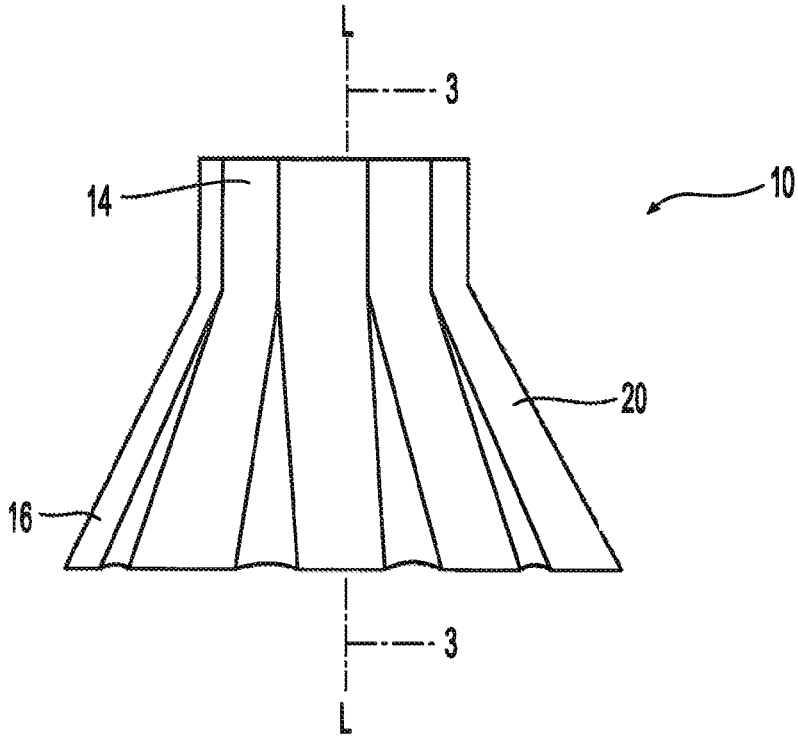
FIG. 2 is a profile view of the head of FIG. 1.
Figure 3:
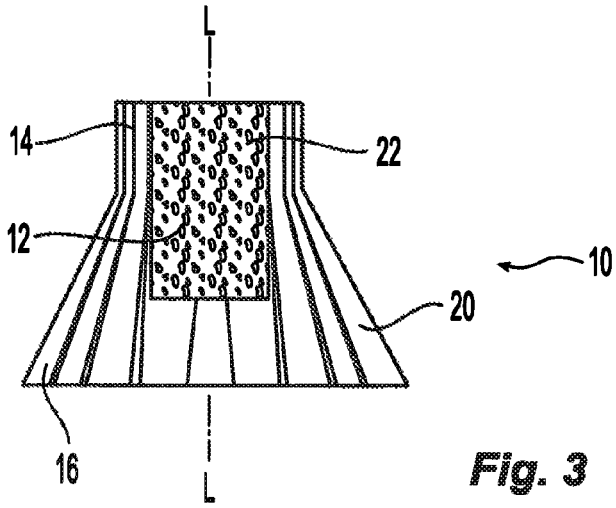
FIG. 3 is a sectional view of the head of FIG. 2, taken along the lines 3-3 of FIG. 2.

Referring to FIGS. 1-3, the invention comprises a head 10 suitable for cleaning a dirty, unsanitary surface. The head 10 may be used while submerged, such as in a toilet bowl or may be used with water added from an external source. The head 10 may be presented as a unit dose, i.e. suitable for use in a single cleaning task, then discarded.

The head 10 may be flushable, i.e. discardable after a single use by flushing down a common toilet. To be flushable, that head 10 may be water disposable. By water disposable it is meant that the head 10 disperses into constituent parts which are small enough to be flushed down an ordinary toilet. Alternatively or additionally, the water disposable head 10 may be water soluble so that it dissolves and is flushed away in solution by an ordinary toilet. It will be apparent to one of skill that a water disposable head 10 may contain certain components which are water dispersible and other components which are water soluble.

The head 10 may be water dispersible. By water dispersible it is meant that the head 10 exhibits visible change when flushed in a typical residential toilet and passes through the waste system. In a degenerate case, the water dispersible head 10 may be water-soluble. By water-soluble it is meant that the material is soluble or otherwise dispersible to solution in 25 degrees C. water at a level of at least 25 weight percent. The head 10 may be usable in cool water, as commonly encountered in a toilet, e.g 10 degrees C. or so. The material selected for the head 10 may further have sufficient strength to prevent unintended tearing and/or leakage of other, and optional, materials in the head 10.

The head 10 may have a weight ranging from 5 to 100 grams, such as 10 to 60 grams and may be generally shaped like an ellipsoid, sphere, paraboloid, satchel, pin cushion, cylinder, parallelpiped, cone, frustrum of a cone or any other suitable shape. The head 10 may have a length taken in the longitudinal direction ranging from 2 to 15, 3 to 10 or 4 to 6 cm. The head 10 may have a diameter at the distal end 16 ranging from 2 to 20, 4 to 15 or 5 to 10 cm. The head 10 may further comprise appendages, protrusions, texture, etc.

The head 10 may have a longitudinal axis. The longitudinal axis may extend from the proximal end 14 of the head 10 to the distal end 16 thereof and be generally centered within said head 10. The head 10 may be generally axisymmetric about the longitudinal axis, with specific corrugations and undulations not being considered. Alternatively, the head 10 may have a cross-section which is the elliptical, generally flat, square or other shapes as desired.

Figure 4:
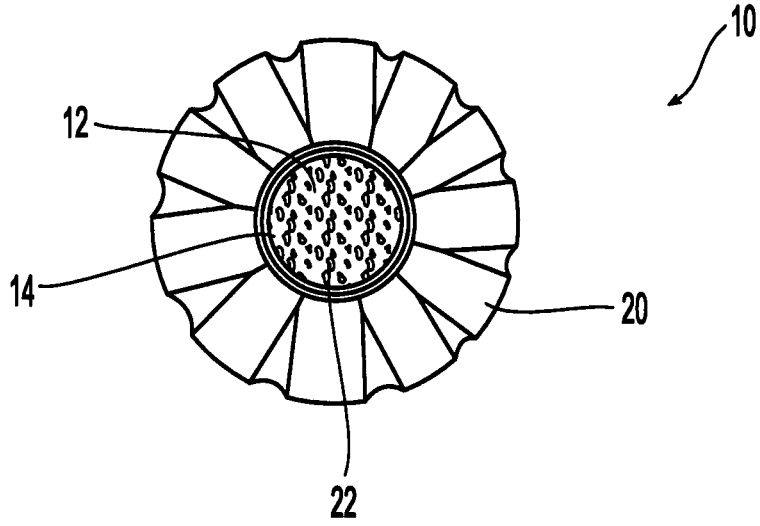
FIG. 4 is a plan view of the proximal end of head of FIG. 1.

Referring to FIG. 4, the head 10 may have a proximal end 14 for attachment to a handle, and a distal end 16 which contacts and cleans the target surface. The proximal end 14 of the head 10 may be compressed to be smaller than the balance of the head 10 and particularly smaller than the distal end 16 thereof. The proximal end 14 of the head 10 may be compressed by applying hoop stresses thereto.

This arrangement provides the benefit that the proximal end 14 may be held in its geometry without the use of adhesive, clips or other binders. The shape may be maintained through hydrogenbonding.

Optionally, water may be added, to assist in forming hydrogen bonds during manufacture. Without being bound by theory, it is believed that the starch material 20 may have a memory and will retain its shape due to the formation process.

One suitable proximal end 14 may comprise a grip. The grip may be suitable for being removably and releasably gripped by an optional handle, and particularly maybe removably and releasably gripped by the distal end 16 of the handle. The user may hold the proximal end 14 of the handle, for manipulation during the cleaning process. The handle may be curved or straight, and provide an extension of the longitudinal axis of the head 10.

Figure 5:
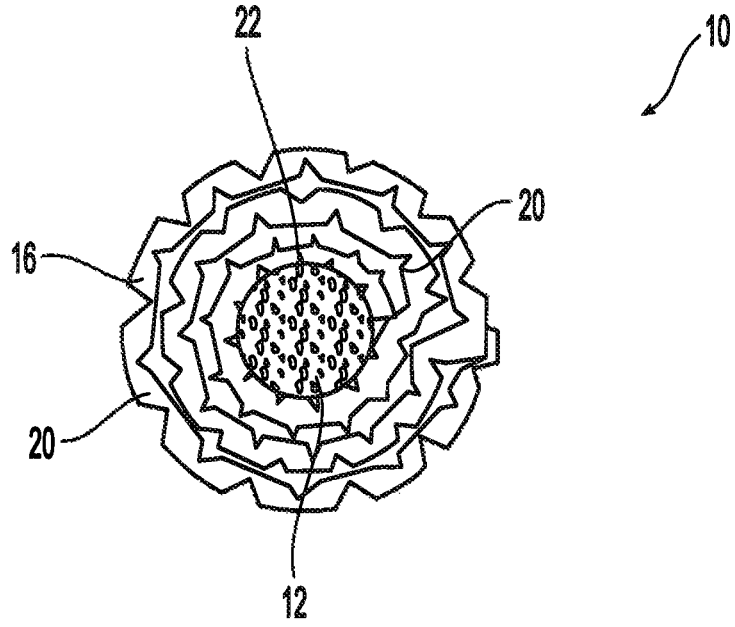
FIG. 5 is a plan view of the distal end of the head of FIG. 1.

Referring to FIG. 5, the distal end 16 of the head 10 may be generally larger and flare outwardly from the proximal end 14, to provide a variable cross-section and more surface area for cleaning. Also, this arrangement provides a proximal end 14 having a relatively higher density. The relatively higher density provides strength for attachment to an optional handle.

This arrangement of flaring outwardly from the proximal end 14 to the distal end 16 provides the further benefit that the proximal end 14 may be relatively small, to accommodate attachment to a handle. The distal end 16 may be relatively larger, to provide more surface area for cleaning.

Referring generally to FIGS. 1-5, the head 10 may comprise a starch-based material. More particularly, the starch-based material may comprise a starch-based foam. The starch may be genetically modified or non-GMO. The starch may include sorghum starch, rice starch, and corn starch. The starch may be high amylase and/or high amylase content, and particularly may be corn starch.

One suitable foam comprises more than 90 weight percent cornstarch, with the balance being additives and processing aids. Such a starch-based material is water soluble, readily biodegradable, and can be assimilated by soil microorganisms as food, according to a representative MSDS sheet. The starch material 20 foam may have a density ranging from 0.01 to 0.5 g/cc.

Raw starch may be mixed with water, so that a blend having 25 to 50 weight percent starch results. The blend may be fed through a high shear, high-temperature extruder. The water flashes to steam under the high temperature, creating the foam in the starch sheet material. After the water flashes to steam, and is subsequently evaporated, the water is no longer considered as a percentage of the material used in the head 10, unless such water is inherently present under ambient conditions.

If desired, the starch may be blended with other polymers. The other polymers may not be hydrophobic, to minimize problems with dissolution, solubility, disperseability, flushability and ultimate biodegradability. Suitable polymers for blending with the starch include biopolymers such as polylactic acid, polycaprolactone, etc. The starch may also be blended with surfactants, bleaches, perfumes, effervescents, cleansers, disinfectants, coatings and combinations thereof. However, the use of polymers which may affect solubility and ultimate biodegradability may be limited. The resulting starch material 20 may have a starch percentage ranging from 50 to 99 weight percent.

During manufacture, the starch-based foam may be extruded in the machine direction. The machine direction may be generally parallel to, i.e. within plus or minus 45° or 30°, of the longitudinal axis of the head 10 described and claimed herein. The starch-based foam may have relatively greater strength in the machine direction than in the cross machine direction. By aligning the machine direction of the with the usage direction, i.e. along the longitudinal axis, of the head 10, applicants have unexpectedly found that a head 10 having a proximal end 14 with sufficient strength to be releasably held by a handle results.

Furthermore, applicants have unexpectedly found that a head 10 having a distal end 16 which resists crumbling, flaking and/or tearing in use results. Applicants have unexpectedly discovered that a starch material 20 having a free edge results in efficacious cleaning of the target surface by the free edge. The free edge may be compressed against the target surface, creating enough pressure to dislodge debris therefrom.

In a degenerate case, the machine direction of manufacture may be parallel to the longitudinal axis of the head 10. Having the machine direction of the starch-based foam in manufacture generally parallel to the longitudinal axis of the head 10 provides the benefit that the strength and abrasive properties of the foam are optimized for use in cleaning a target surface such as a toilet, which has a wetted surface below the water line and a dry, or less wet surface, above the water line.

The starch-based substance, such as a starch-based foam may be extruded as a sheet. This sheet may have a thickness ranging from 1 mm to 130 mm or from 2 to 20 mm. The extruded sheet may be of constant thickness and flat. Alternatively, the extruded sheet may be of constant thickness and corrugated in the MD. Alternatively, the extruded sheet may be of variable thickness, and may be grooved, corrugated, etc. Alternatively, the starch material 20 may be extruded in a honeycomb pattern, or as any desired polygon, circular shape, etc.

The starch material 20 may be a foam, and particularly a closed cell foam. The cells may have a size with a major dimension ranging from 1 to 1000, 100 to 700 or 400 to 600 microns. Suitable starch-based substance may be obtained from KTM industries Inc. of Lansing, Mich. as Green Cell™ Foam Sheet After extrusion into a starch based substance sheet, the sheet may be cut into strips. The cuts may be generally parallel to the CD, so that the relatively stronger direction of the sheet is aligned with the direction of compression, resulting in more integrity of the head 10 during use. This arrangement generally aligns the MD of the sheet with the longitudinal axis of the resulting head 10.

The strips may be spiral wound, to form a longitudinal axis. The MD may be generally parallel to or even coincident the longitudinal axis.

The sheet(s) of starch based material may have cleanser added thereto. The cleanser may comprise surfactant and related materials known to one of skill to increase the cleansing ability of the head 10. The cleanser may further comprise disinfectants to sanitize the surface, dyes to alert the user to the presence of the cleanser, perfumes for odor control, polymeric soil repellants and/or waxes.

The cleanser may be fully or partially coated on one side of the sheet. Alternatively, the cleanser may be coated onto both sides of the sheet, to increase efficacy. Alternatively, two different cleansers may be used, one on each side of the sheet. Alternatively two or more cleansers may be zone coated on one or both sides of the sheet. Alternatively, the cleanser may be impregnated into and throughout the sheet during the manufacturing process.

Referring to FIG. 3, the head 10 may further comprise a stiffening member 12. A stiffening member 12 is any component added to the head 10 which increases the compressive strength thereof over a like head 10 without such member. The stiffening member 12 may be disposed as a core of the head 10. The starch material 20 may form a shell around the core.

The core, or other portions of the head 10, as desired, may comprise granular material 22. The granular material 22 may comprise a homogeneous or heterogeneous distribution of one or more granular material 22. By granular, it is meant that the materials have an individual particle size less than 5 mm in any direction. The granular material 22 may have a particle size distribution ranging from 1 to 5000 microns or 300 to 1000 microns as measured by a laser micrometer.

The granular material 22 may be compressed to form a tablet configuration. Alternatively or additionally, the granular material 22 may absorb ambient moisture, causing solidification into a defined and solid shape and form.

If used as a core, the granular material 22 may be formed into a solid shape, such as a plug. The plug may be cylindrical and of constant cross section or may be of variable cross section. Or the plug may be of any other desired cross section. The plug may be formed using a press die, as is known in the art.

For the invention claimed herein the granular material 22 may be alternatively or additionally be free-flowing and farinaceous, and may include individual fibers of cellulose. The granular material 22 may be water soluble, water dispersible, or simply small enough to be flushable.

The granular material 22 may further create a texture of asperities. These asperities may locally increase pressure on the target surface in response to compression applied by the user through the handle. The local increase in pressure may assist in scrubbing stains etc. from the toilet bowl. The granular material 22 may be in the shape of rods, sheets, spheres and/or combinations thereof and have a particle size from 1 to 13,000 or 100 to 5000 microns.

The granular material 22 may comprise one or more of a surfactant, detergent, carboxylic acid, foaming agents, oxidants, enzymes, anti-soiling polymers, inorganic/organic abrasives, perfumes, chelants, etc. and combinations thereof. The oxidants may be used for bleaching, disinfection, and breaking down organic materials. Chlorine oxygen bleaches, and/or reducing agents may be selected. Likewise, enzymes may be used to digest organic materials. One or more pH modifiers may also be included, such as acids for de-scaling the toilet bowl and/or caustics to further break down organic material. Polymeric ingredients are known for incorporation into cleaning compositions and may be incorporated into the head 10. Detergent compositions comprising a cleaning polymer are taught in commonly assigned WO 06/130442 and WO 06/130575.

A granular material 22 may comprise a surfactant, organic acid or a combination thereof. The surfactants may be anionic, nonionic, zwitterionic, ampholytic, cationic and mixtures thereof. The granular material 22 may additionally or alternatively include fatty acids and/or soaps thereof.

Nonionic surfactants may be of the formula $R^1(OC_2H_4)_n$ OH, wherein $R^1$ is a $C_{10}$-$C_{16}$ alkyl group or a $C_8$-$C_{12}$ alkyl phenyl group, and n is from 3 to 80, and may further condensation products of $C_{12}$-$C_{15}$ alcohols with from 5 to 20 moles of ethylene oxide per mole of alcohol, e.g., $C_{12}$-$C_{13}$ alcohol condensed with 6.5 moles of ethylene oxide per mole of alcohol. A suitable surfactant granular material 22 is available from the Stepan Co. of Northfiel, Ill. under product name Bio-Terge® AS-90 beads. Alternatively or additionally, the cleanser used with the present invention may include akly polyglucosides, as disclosed in commonly assigned U.S. Pat. No. 6,716,805.

If a carboxylic acid granular material 22, and particularly an organic acid granular material 22 is selected for the granular material 22, a suitable organic acid may have a pH ranging from 1 to 6.9 or from 3 to 5. The organic acid may be selected from the group consisting of lactic acids, acetic acids, formic acids, citric acids, oxalic acids, tartaric acid, glycolic acid, ascorbic acid, phthalic acid, fumaric acid, adipic acid, succinic acidsit's just a, malic acid, maleic acid, trichlorocyanuric acid, uric acids and combinations thereof. An organic acid having a relatively low molecular weight, e.g. formic acid or lactic acid, may be selected for miscibility in water. Acids salts such as sodium dihydrogen phosphate, disodium dihydrogen pyrophosphate, acid citrate salts and sodium acid sulfite may be used. Alternatively or additionally a crystalline citric acid of $C_6H_8O_7$ and derived from carbohydrate fermentation, lemon, lime, pineapple juice and combinations thereof may be used. If an organic acid granular material 22 is selected, a suitable organic acid granular material 22 is available from EMD Chemicals Inc. of Gibbstown, N.J.

If desired, the stiffening member 12, or other portion of the head 10, may further comprise particulate materials. By particulate, it is meant that the materials do not disperse or dissolve in water, in contrast to the granules which do. Particulates may include, without limitation, for example, diatomaceous earth, coconut shell fibers, walnut shells, crushed sea shells, calcium carbonate, sodium dodecyl benzene sulfonate, zeolites and/or other abrasives and combinations thereof. The particulates provide the benefit of an aggressive material suitable for scrubbing above or below the waterline. The particulates may be of small size, to maintain flushability. The particulates may have a diameter less than 100, 75 or 50 microns.

If desired, the head 10 may further comprise an effervescent. An effervescent will produce gas in the form of bubbles when submerged below the water line of the toilet. The gas production results in disturbance of the water, potentially helping to break up components of the head 10 and thereby improve flushability and water disposability. The effervescent may comprise sodium bicarbonate, etc.

Figure 6:
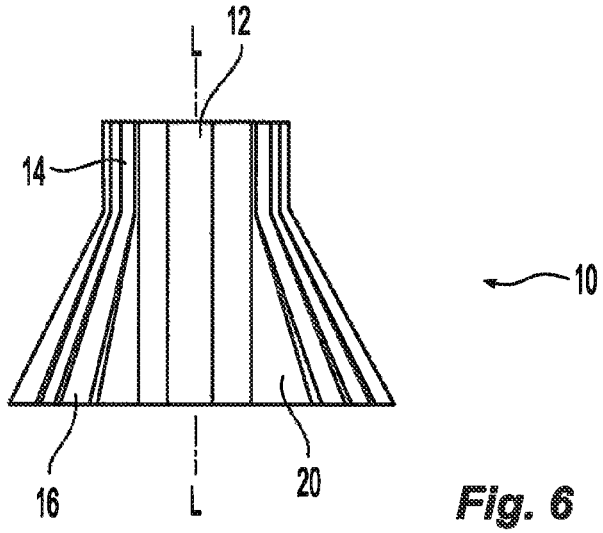
FIG. 6 is a vertical sectional view of an alternative embodiment of a head having a hollow core.

Referring to FIG. 6, if desired the head 10 may comprise a generally hollow stiffening member 12 as a core. A hollow stiffening member 12 may be made of water soluble cardboard, as is known in the art. Additionally or alternatively, the hollow core may comprise water soluble polyvinyl alcohol film, hereinafter referred to as PVOH film, as is known in the art. Of course, one of skill will recognize that a stiffening member 12 comprising water soluble cellulosic materials, PVOH materials, combinations thereof, may be solid, or a portion of the length thereof may be solid. The PVOH film may disperse or even dissolve with mild agitation in cold water within 10 to 300, 30 to 180 or 45 to 90 seconds of being immersed in the water.

The PVOH film can, for example, be obtained by casting, blow-molding, extrusion or blown extrusion of polymeric material, as known in the art. Optionally, PVOH material may be cast into a suitable shape which does not comprise a film, and still be usable as a stiffening member 12.

Polymers, copolymers or derivatives thereof suitable for use as shell 12 material may be selected from polyvinyl alcohols, polyoxethylene, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragumand may include polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and may further include polyvinyl alcohols, polyvinyl alcohol copolymers and hydroxypropyl methyl cellulose (HPMC), and combinations thereof. The level of polymer in the film material, such as a PVOH polymer, may be at least 60 weight percent. The polymer can have a weight average molecular weight, such as 1000 to 1,000,000; 10,000 to 300,000 or 20,000 to 150,000.

If a PVOH film is selected for all or a part of the stiffening member 12, it may have a water content ranging from 8 to 12 weight percent, a thickness of 76 microns and a tensile strength sufficient to resist shear forces encountered in use. PVOH film sold under the trade name Monosol® M8630, as sold by MonoSol LLC of Merrillville, Ind., US, and PVOH films of corresponding solubility and deformability characteristics may be suitable for the film. Films known under the trade name PT film or the K-series of films supplied by Aicello, or VF-HP film supplied by Kuraray may also be suitable for the film.

Figure 7:
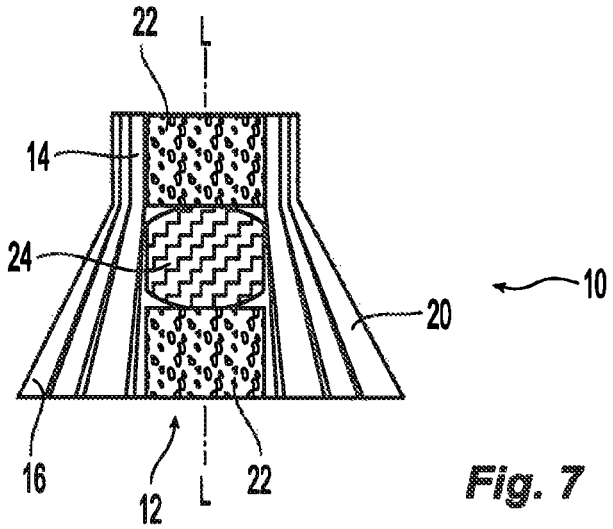
FIG. 7 is a vertical sectional view of an alternative embodiment of a head having a core comprising a liquid pouch interposed between two granular tablets.

Referring to FIG. 7, a compound stiffening member 12 may be selected. An illustrative compound stiffening member 12 comprises one or more core segments of granular material 22. The core segments may contain identical or different compositions of granular material 22.

If different compositions of granular material 22 core segments are selected, the core segment closer to the distal end 16 of the head 10 may contain surfactant, cleanser, abrasives and like materials suitable for the beginning portion of the cleaning process. The core segment closer to the proximal end 14 of the handle may contain effervescent, perfume, disinfectant, coatings and like materials suitable for the later portion of the cleaning process.

Alternatively or additionally the granular material 22 may be free-flowing. If so, the granular material 22 may be contained within a pouch. The pouch may be formed of PVOH film, as described herein. And/or the film may be used to coat and or contain the starch based substance.

Interposed between the core segments comprising granular material 22 may be a pouch of liquid material 24. The liquid material 24 may comprise a cleanser, as is known in the art. The cleanser may comprise surfactant, perfume, citric acid, other acids, detergent, bleach, etc. as is known in the art. The pouch may be formed of PVOH film, as described herein.

While a compound stiffening member 12 having two core segments comprising granular material 22 and a singular core segment comprising a liquid pouch 24 is shown, the invention is not so limited. Any number of core segments comprising granular material 22, and any number of core segments may be used for the core. Of course, one of skill will recognize that plural liquid segments 24 of the core may be disposed adjacent to each other, plural granular material 22 segments of the core may be disposed adjacent to each other, or such segments 22, 24 may be intermixed.

Figure 8:
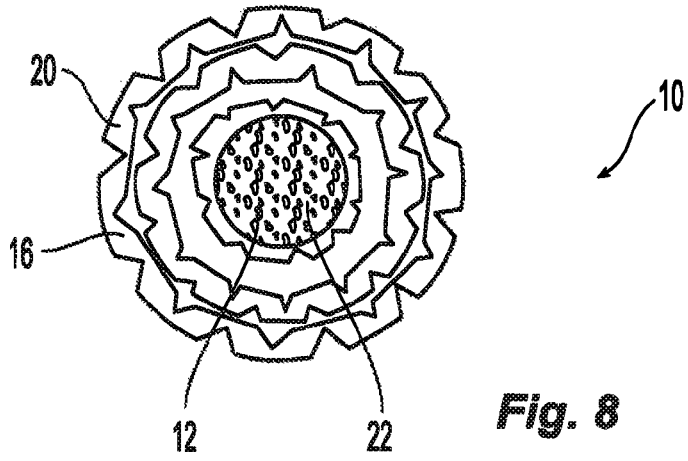
FIG. 8 is a plan view of the distal end of an alternative embodiment of a head having a granular core having three concentric layers of extruded starch material which are not spiral wound.

Referring to FIG. 8, if desired, the head 10 may be extruded as a solid or hollow conical or frustroconical shape. This process ensures the longitudinal direction of the head 10 will be coincident the MD. Alternatively, the head 10 may extruded as a cylinder, parallelpiped or other solid shape of constant cross section. After extrusion the proximal end 14 may optionally be formed as described above.

Figure 9:
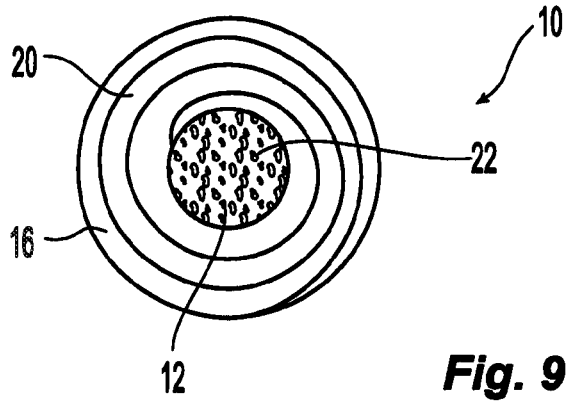
FIG. 9 is a plan view of the distal end of an alternative embodiment of a head having spiral wound starch sheet material which is not corrugated.

Referring to FIG. 9, the starch material 20 may be provided in a form having no corrugations, and is a relatively dense sheet. This sheet may be spiral wound to form the head 10 of the present invention. This arrangement provides the benefit that a head 10 having relatively greater density occurs. The relatively greater density provides increased stiffness during cleaning. The increased stiffness may render the optional stiffening member 12, and particularly the optional core, unnecessary.

Figure 10:
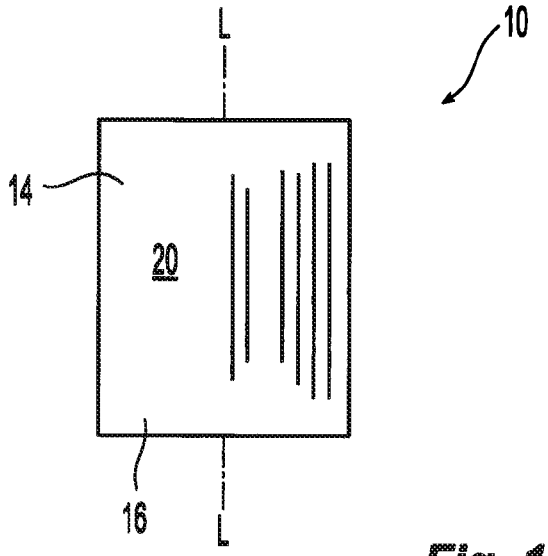
FIG. 10 is a profile view of an alternative embodiment of the head having the starch material extruded as a right circular cylinder.

Referring to FIG. 10, the starch material 20 may be extruded, cast or otherwise formed as a solid. This arrangement provides a starch material 20 which is homogeneous throughout and is free of the optional head 10. A constant cross section, and particularly a round cross section may be selected. Alternatively, an elliptical, polygonal or other cross section may be selected.

Figure 11:
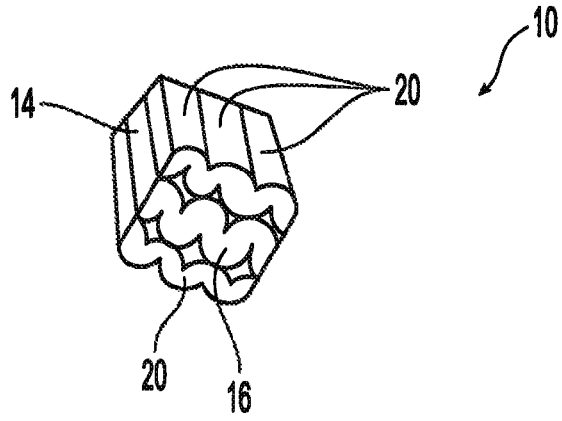
FIG. 11 is a perspective view of an alternative embodiment of a head comprising three layers of corrugated starch material laminated in face to face relationship.
Figure 12:
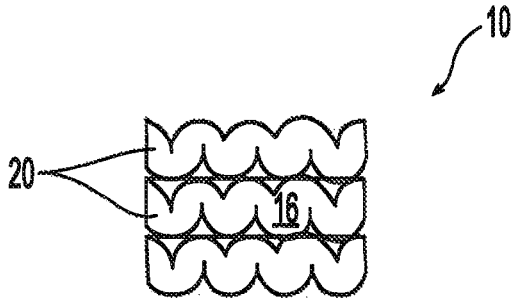
FIG. 12 is a bottom plan view of the head of FIG. 11.

Referring to FIGS. 11-12, several sheets of starch material 20, or strips thereof, may be joined together to form a laminate. The laminate may be joined at one edge, to form a proximal end 14 of the head 10. The sheets may be of identical width or variable width and/or identical thickness and or variable thickness. If corrugated sheets are selected, the interstitials between the sheets may be empty or may be used to optionally contain cleanser, etc.

Figure 13:
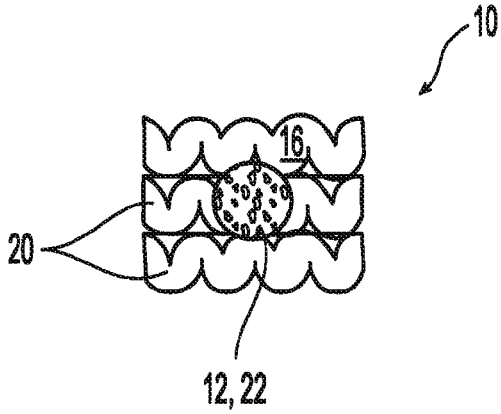
FIG. 13 is a bottom plan view of an alternative embodiment of a head according to FIG. 11 and having a stiffening member comprising granular material.

Referring to FIG. 13, if desired, the embodiment of the head 10 made of sheets of starch material 20 disposed in face to face relationship to form a laminate, may further comprise an optional stiffening member 12.

The stiffening member 12 may be juxtaposed with the proximal end 14 of the head 10. This arrangement provide the benefit that the stiffening member 12 can increase the strength of the grip of the proximal end 14, and thereby improve attachment to an optional handle.

The optional stiffening member 12 of this embodiment, or any embodiment described and claimed herein may be of equivalent length to the starch material 20 as taken in the longitudinal direction. Alternatively, the optional stiffening member 12 may be of greater longitudinal length than the starch material 20.

Alternatively, the optional stiffening member 12 may be of lesser longitudinal length than the starch material 20. If a granular material 22 is selected for the stiffening member 12, the granular material 22, or any other material selected, may be recessed from the distal end 16 and periphery of the head 10. This arrangement provides the benefit that, for the exemplary and non-limiting use of cleaning a toilet, the head 10 is immersed in water and the granular material 22 softened before contacting the target surface.

A stiffening member 12 is a member which increases resistance of the head 10 to compression in the longitudinal direction. The stiffening member 12 may be any suitable material which increases resistance at least 25 percent over the resistance of the starch taken alone. The resistance to compression may be determined by providing a quantity of the two materials to be considered. The materials may have a common length of 5 cm and any suitable and like cross section. The materials are place in a tensile machine and compressed at a cross head speed of 30.5 cm per minute. The highest force readings are recorded and compared, to determine whether or not one material is a stiffening member compared to the other.

Figure 14:
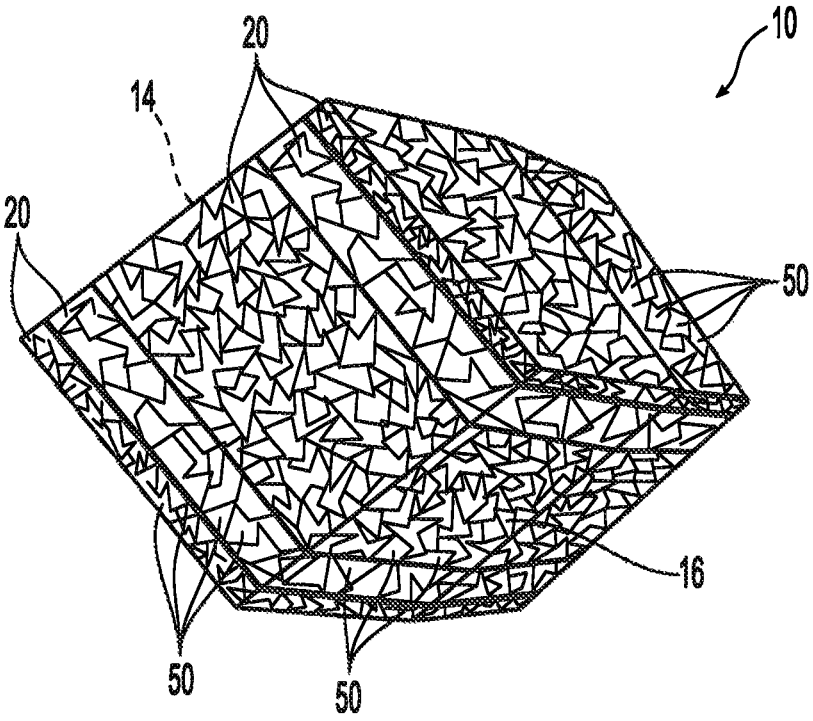
FIG. 14 is a perspective view of an alternative embodiment of a head having flat layers of starch material disposed in face to face relationship and having mutually different widths.

Referring to FIG. 14, in one embodiment the head 10 may have a plurality of sheets of starch material 20. The sheets may be flat, i.e. be free of corrugations, grooves, rugosities, undulations, etc. For example, the head 10 may have five starch based sheets joined together at a single edge. The central sheet of the five sheets may have a greater thickness than the two adjacent sheets flanking the central sheet. The two adjacent sheets may, in turn, have a greater thickness than the two outer sheets.

This arrangement provides the benefit that the central sheet having a relatively greater thickness, and thus greater section modulus, may provide relatively greater scrubbing capability for more difficult stains. The outer sheets having a relatively lesser thickness, and thus lesser section modulus, may provide relatively greater flexibility for cleaning nooks and crannies.

While five sheets are illustrated, one of skill will recognize that any reasonable number of sheets may be utilized. If plural sheets are used, the sheets may have the respective machine directions oriented in different direction to provide more homogenous material properties such as elongation and strength. Of course, a single sheet may have the machine direction (MD) oriented parallel to the longitudinal axis, the MD may be perpendicular to the longitudinal axis (i.e. with the CD parallel to the longitudinal axis) or any angle therebetween.

Optionally, one or more of the plurality of sheets may be slit in a direction having a vector component parallel to the longitudinal axis and may be coincident the direction of the longitudinal axis. This arrangement provides the benefit that the head 10 can more easily conform to the contours of the target surface to be cleaned. By providing some relatively stiffer sheets of starch material 20, with or without cut strips, cleaning of multiple soils from multiple target services may be more readily accommodated.

This arrangement, like the previous embodiments, provides the benefit that an edge of the starch based substance is presented to the target surface. The edge concentrates compressive force applied by the user into a compressive pressure efficacious for cleaning.

FIG. 14 illustrates another variation usable with any embodiment described herein. Instead of or in addition to sheets of extruded starch material 20, the head 10 may comprise starch material 20 formed from a plurality of particulates 50 of starch material 20 joined together. The particulates 50 of starch material 20 may be joined together using water soluble adhesive, as is known in the art.

The head 10, and any portion thereof, may include or be free of nonwoven sheets, tissue grade cellulose etc. The head 10 may further be free of any material which is not a starch material 20. As used in this context a starch material 20 includes material blended with the starch as it is extruded or otherwise formed.

Optionally the outwardly facing surface of the head 10 may further comprise a macrotexture. A macrotexture is a texture generally significantly larger than the texture presented by any one granule, corrugation in the starch material 20, etc.

The macrotexture may optionally comprise a plurality of outwardly extending protuberances. The protuberances may extend outwardly from the surface a distance of 2 to 10 or 3 to 6 mm.

Optionally, the head 10 may contain coating material. The coating material becomes deposited upon the target surface during the cleaning operation. The coating reduces soil deposition on that target surface, improving the clean appearance and potentially lengthening the time between cleanings.

Suitable coating materials include silicone and polyvinylpyrrolidone (PVP). One of skill will recognize that the coating materials must be applied in quantities which do not interfere with the flushability of the head.

The head 10 according to the present invention may be packaged for individual sale and use. Alternatively, a plurality of head 10 may be packaged together for sale in a single purchase. The package of plural head 10 may contain mutually identical head 10 or may contain head 10 which vary by size, chemistry, form factor, etc.

The packaging for the head 10 or a plurality of heads 10 may comprise a moisture barrier material, as is known in the art. This arrangement provides the benefit that degration of the head does not prematurely occur. If desired, an optional dessicant may be included in the packaging.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A water disposable head for cleaning a target surface, said head having a longitudinal axis therethrough and comprising:

a predominantly starch based material having hydrogen bonding, said head extending from a proximal end attachable to a handle to a distal end longitudinally remote therefrom wherein said starch based material comprises sheet material and wherein said sheet material has a first face and a second face opposed thereto, said head being free of adhesive and further comprising a cleanser, said cleanser being disposed as a coating on one said face of said sheet material.

2. A water disposable head according to claim 1 wherein said head diverges outwardly from said proximal end to said distal end.

3. A water disposable head according to claim 2 wherein said sheet material is water soluble.

4. A water disposable head according to claim 3 comprising a starch material having at least 45 weight percent amylose.

5. A water disposable head according to claim 4 comprising a starch material having a continuous matrix of corn starch.

6. A water disposable head according to claim 5 wherein said sheet material has a first face and a second face opposed thereto, said head further comprising a first cleanser being disposed as a coating on one said face of said sheet material and a second cleanser being disposed on said second face of said sheet material, said first cleanser and said second cleanser being mutually different.

7. A water disposable head for cleaning a target surface, said head, having a longitudinal axis therethrough and said head comprising:

an extruded starch material having hydrogen bonding and forming a generally axisymmetric shape, said starch material having a machine direction generally aligned with said longitudinal axis said head being free of adhesive and further comprising a cleanser comprising particulate material and/or granular material.

8. A water disposable head according to claim 7 comprising a plurality of sheets, said plurality of sheets being disposed in face to face relationship to form a laminate of starch based materials.

9. A water disposable head according to claim 7 wherein said starch material comprises a sheet of starch based material spiral wound upon itself.

10. A water disposable head according to claim 9 wherein said sheet of starch based material is corrugated.

11. A water disposable head according to claim 7 wherein said head has a generally constant cross section from said proximal end to said distal end.

12. A water disposable head having a longitudinal axis, being attachable to a cleaning implement and for cleaning a toilet, said head comprising:

an extruded starch foam material having a plurality of hydrogen bonded closed cells therein, said closed cells having a major dimension generally aligned with said longitudinal axis said head being free of adhesive.

13. A water disposable head according to claim 12, wherein said foam material is folded back upon itself in a zigzag pattern.

14. A water disposable head according to claim 12 comprising a plurality of laminae joined in face-to-face relationship.

15. A water disposable head according to claim 14 wherein said laminae are generally polygonally shaped, are joined at a common proximal edge and are free at a distal edge remote from said proximal edge.

16. A water disposable head according to claim 15 wherein at least some of said laminae in said plurality of laminae have mutually different thicknesses.

17. A water disposable head according to claim 14 wherein said laminae are joined to form a laminate, said laminate being attachable to a handle, said laminate forming a plane, said plane being generally perpendicular to said longitudinal axis when attached to a handle.

18. A water disposable head according to claim 12 made according to the process comprising the steps of:

extruding starch material in a machine direction to form a sheet thereof;

forming said sheet into a head having a longitudinal axis; and maintaining said machine direction parallel to said longitudinal axis while forming said head.

* * * * *